United States Patent [19]

Auer et al.

[11] Patent Number: 4,889,516

[45] Date of Patent: Dec. 26, 1989

[54] PLUG-IN MODULE FOR MOTORIZED TOY VEHICLE

[75] Inventors: Robert T. Auer, East Stroudsburg, Pa.; David Reina, Maplewood, N.J.

[73] Assignee: Buddy L Corp., New York, N.Y.

[21] Appl. No.: 122,253

[22] Filed: Nov. 16, 1987

[51] Int. Cl.[4] ..... A63H 33/04; A63H 17/26; A63H 29/02

[52] U.S. Cl. ..... 446/462; 446/470; 446/449; 446/90

[58] Field of Search ..... 446/90, 95, 443, 457, 446/462, 448, 449, 431, 439, 461, 463, 456, 470, 471, 484, 93

[56] References Cited

U.S. PATENT DOCUMENTS

| | | | |
|---|---|---|---|
| 2,679,712 | 6/1954 | Schwien et al. | 446/443 |
| 3,041,485 | 6/1962 | Jolley | 446/462 X |
| 3,608,233 | 9/1971 | Aoki | 446/90 |
| 3,634,969 | 1/1972 | Harlting et al. | 446/463 |
| 3,659,378 | 5/1972 | Tong | 446/443 X |
| 3,818,632 | 6/1974 | Tong | 446/443 |
| 4,045,908 | 9/1977 | Ensmann et al. | 446/457 X |
| 4,189,864 | 2/1980 | Saito | 446/90 |
| 4,349,984 | 9/1982 | Goldfarb et al. | 446/93 |
| 4,406,085 | 9/1983 | Rhodes | 446/456 |
| 4,514,477 | 4/1985 | Kobayashi | 446/462 X |
| 4,573,943 | 3/1986 | Kennedy et al. | 446/443 X |
| 4,698,044 | 10/1987 | Kennedy et al. | 446/462 X |

FOREIGN PATENT DOCUMENTS

| | | | |
|---|---|---|---|
| 2949615 | 12/1979 | Fed. Rep. of Germany | 446/462 |
| 1423426 | 3/1972 | United Kingdom | 446/470 |
| 2154152 | 9/1985 | United Kingdom | 446/471 |

*Primary Examiner*—Robert A. Haffer
*Assistant Examiner*—D. Neal Muir
*Attorney, Agent, or Firm*—Michael Ebert

[57] ABSTRACT

A power module which when plugged into an open compartment in the body of a motorless toy vehicle and switched on, then acts to drive the vehicle in a selected direction. The compartment is disposed above a coupling gear mounted on a wheel axle. The case of the module simulates the appearance of a multi-cylinder engine nad houses a DC motor and a battery supply therefor, the motor being operatively coupled to a drive pinion whose teeth project below the base of the case to engage the coupling gear whereby when the motor is energized, the wheel axle is caused to turn to propel the vehicle. The upper end of the case which projects above the body has a rocker pivoted thereon which simulates an air scoop for the engine and functions as the actuator for a polarity-reversing switch connecting the battery supply to the motor. When the rocker is inclined down toward the front, the resultant switching action causes forward motion of the vehicle, the vehicle moving in the reverse direction when the rocker is inclined down toward the rear.

9 Claims, 5 Drawing Sheets

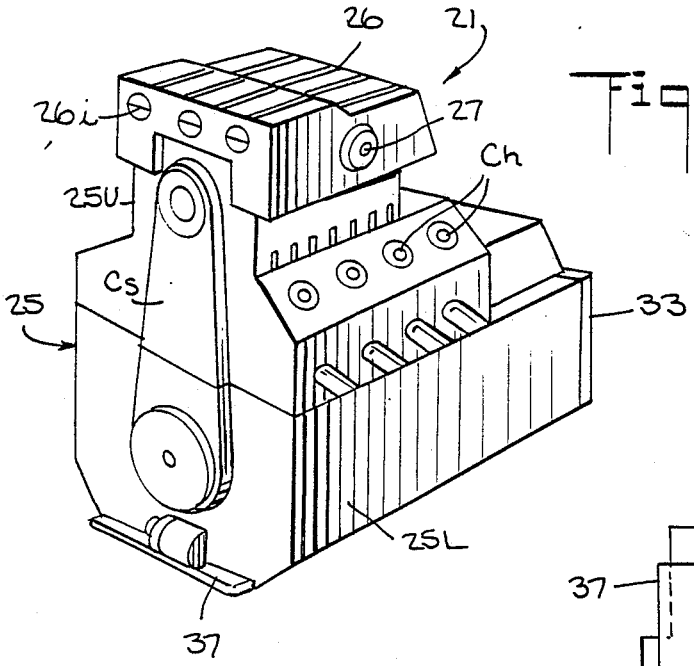
Fig. 3.
Fig. 4.
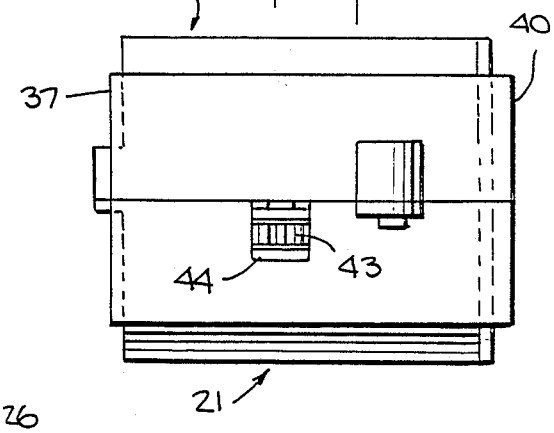
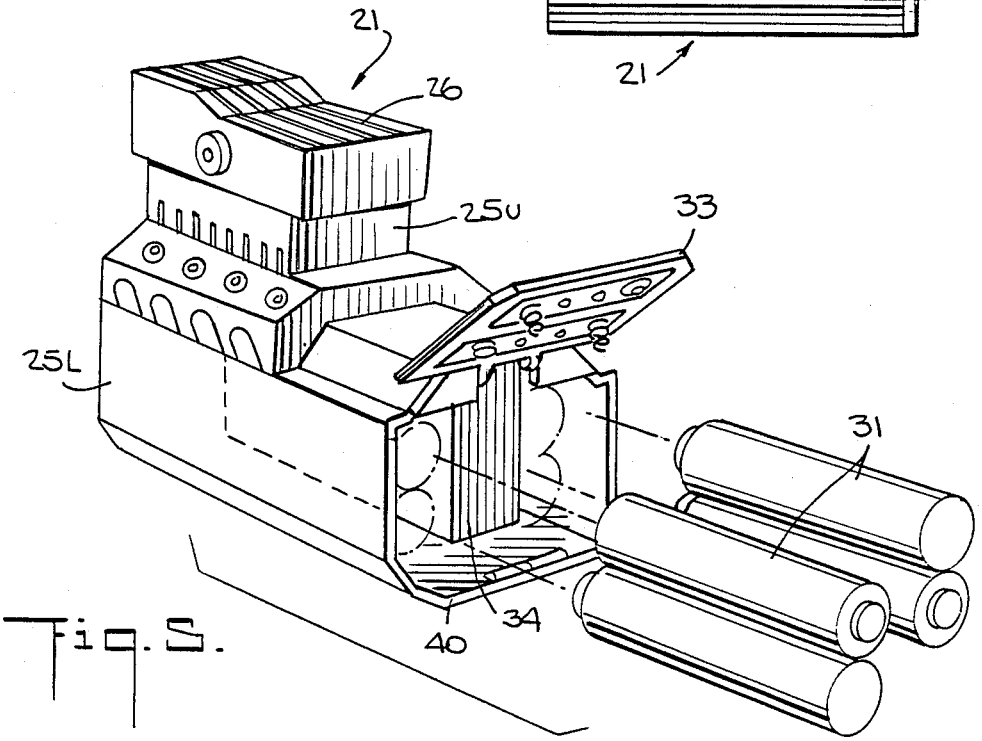
Fig. 5.

PLUG-IN MODULE FOR MOTORIZED TOY VEHICLE

BACKGROUND OF INVENTION

1. Field of Invention

This invention relates generally to motorized toy vehicles provided with a battery-operated DC motor, and more particularly to a self-sufficient power module which encases the motor and a battery supply therefor, the module being pluggable into an open compartment in the body of any one of a family of toy vehicles, the module, when switched on, acting to propel the vehicle in a selected direction whereby the same power module is usable to propel all vehicles in the family.

2. Status of Prior Art

The typical motorized toy vehicle includes a miniature DC motor connected through a polarity-reversing switch to a battery supply. The motor is operatively geared to at least one wheel axle, so that when the motor is switched on, the vehicle is propelled in a direction that depends on the polarity of the applied voltage.

In play, children usually seek as best they can to initiate an observed adult activity. Play, therefore, represents a learning experience that prepares the child for the adult world. Thus a child who plays with a toy combat weapon prefers a toy whose appearance resembles that of an actual weapon, and a child who plays with toy cars or trucks is happiest with those that behave and look like vehicles of the type he has seen driven by adults.

Also, children enjoy playing with an assortment or family of different vehicles such as cars, trucks, trailers, buses, tractors and other vehicles normally encountered on the road, for each vehicle has a specialized function and therefore calls for a play activity appropriate to this function. But should one wish to provide a child with a group of different motorized toy vehicles each having its own motor and battery supply, the overall cost of this group of toys will necessarily be high, for the motor, the battery supply and the gear train to link the motor to a wheel axle represent a substantial portion of the manufacturing cost of the vehicle.

It is known to provide a toy motorized vehicle with a self-sufficient DC motor power pack which is insertable into a body compartment to drive the vehicle. Such prior arrangements are disclosed in U.S. Pat. Nos. 3,659,378 and 3,733,744. But these patented power packs do not resemble a conventional multicylinder internal combustion engine and therefore lack verisimilitude. Children who have seen a racing car with an exposed engine or the engine of a typical vehicle when its hood is raised, know what a real internal combustion engine looks like, and are therefore dissatisfied with a toy vehicle having an electric motor.

SUMMARY OF INVENTION

In view of the foregoing, the main object of this invention is to provide a power module which when plugged into an open compartment in the body of a toy vehicle and switched on, then acts to drive the vehicle in a selected direction.

A significant feature of the invention is that the appearance of the plug-in power module suggests that of a standard multi-cylinder internal combustion engine, the upper section of the module projecting above the body of the toy vehicle and being visible to the player; as a consequence of which the player enjoys the experience of installing this familiar engine in a toy vehicle and of seeing it operate.

More specifically, an object of the invention is to provide a power module of the above type which can be plugged into an open compartment in a family of different toy vehicles so that the same power module functions to drive any selected vehicle in the family.

An important economic advantage of the invention is that the manufacturing cost of each vehicle in the family thereof is relatively low, for none of the vehicles includes a DC motor, a battery supply therefor, and a gear train to operatively couple the motor to a wheel axle; for these elements are all housed in a single module usable with any one of the vehicles in the family.

Also an object of the invention is to provide a power module having an actuator for a polarity-reversing switch to connect the battery supply to the motor, the switch being actuated by a rocker pivoted to the upper end of the module case and resembles an air scoop for the engine, thereby enhancing the impression that the vehicle is powered by a real engine.

Yet another object of the invention is to provide a power module having a snap-and-go action, such that when the module is switched on and then snapped into the open compartment of the vehicle, the vehicle is immediately propelled into action. Thus children provided with this toy can engage in races to see who is faster in getting his vehicle on the road.

Briefly stated, these objects are attained in a power module which when plugged into an open compartment in the body of a motorless toy vehicle and switched on, then acts to drive the vehicle in a selected direction. The compartment is disposed above a coupling gear mounted on a wheel axle. The case of the module simulates the appearance of a multi-cylinder engine and houses a DC motor and a battery supply therefor, the motor being operatively coupled to a drive pinion whose teeth project below the base of the case to engage the coupling gear whereby when the motor is energized, the wheel axle is caused to turn to propel the vehicle. The upper end of the case which projects above the body has a rocker pivoted thereon which simulates an air scoop for the engine and functions as the actuator for a polarity-reversing switch connecting the battery supply to the motor. When the rocker is inclined down toward the front, the resultant switching action causes forward motion of the vehicle, the vehicle moving in the reverse direction when the rocker is inclined down toward the rear.

BRIEF DESCRIPTION OF DRAWINGS

For a better understanding of the invention as well as other objects and further features thereof, reference is made to the following detailed description to be read in conjunction with the accompanying drawings, wherein:

FIG. 3 is a separate front view, in perspective, of the power module;

FIG. 4 is a bottom view of the power module showing the exposed drive pinion;

FIG. 5 is a rear perspective view of the power module showing the hinged lid thereof raised to receive the batteries for the motor;

DESCRIPTION OF INVENTION

The Assembly and Its Components

Figure 1:
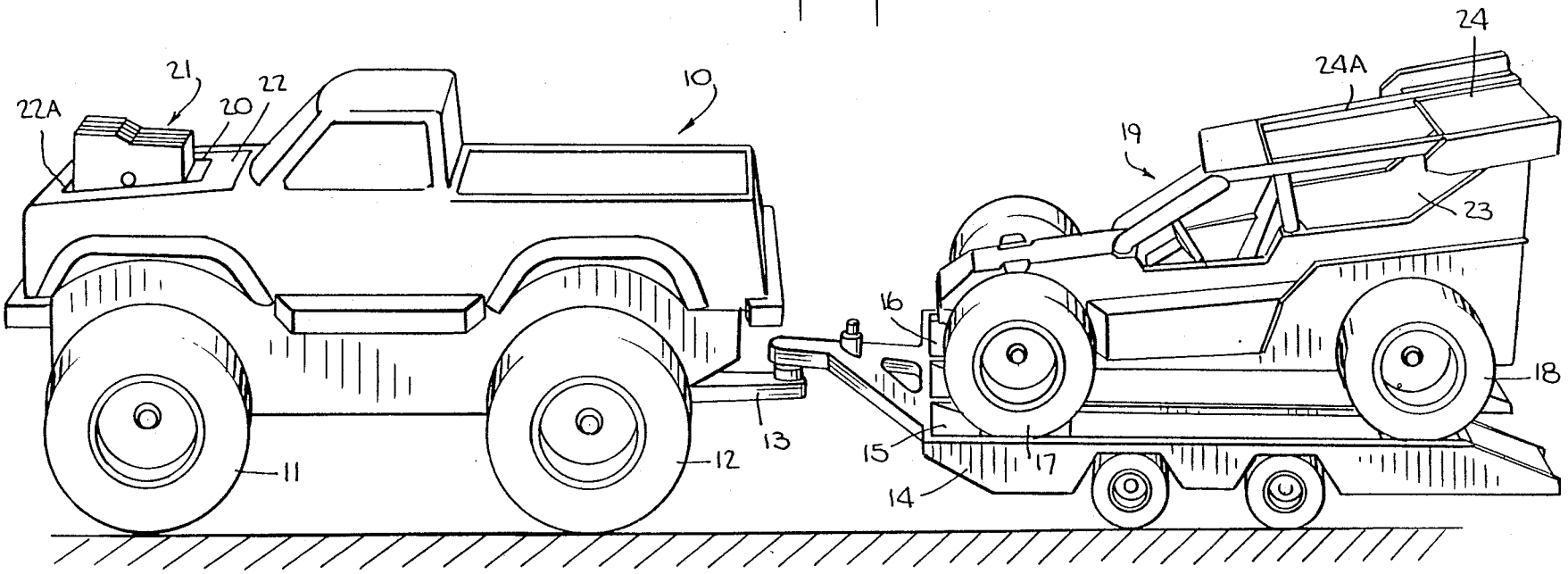
FIG. 1 is a perspective view of a preferred embodiment of the invention which takes the form of an assembly constituted by a toy pick-up truck onto which is hitched a trailer carrying an off road sandscorcher, the truck and sandscorcher each having an open compartment into which is pluggable the same power module.
Figure 2:
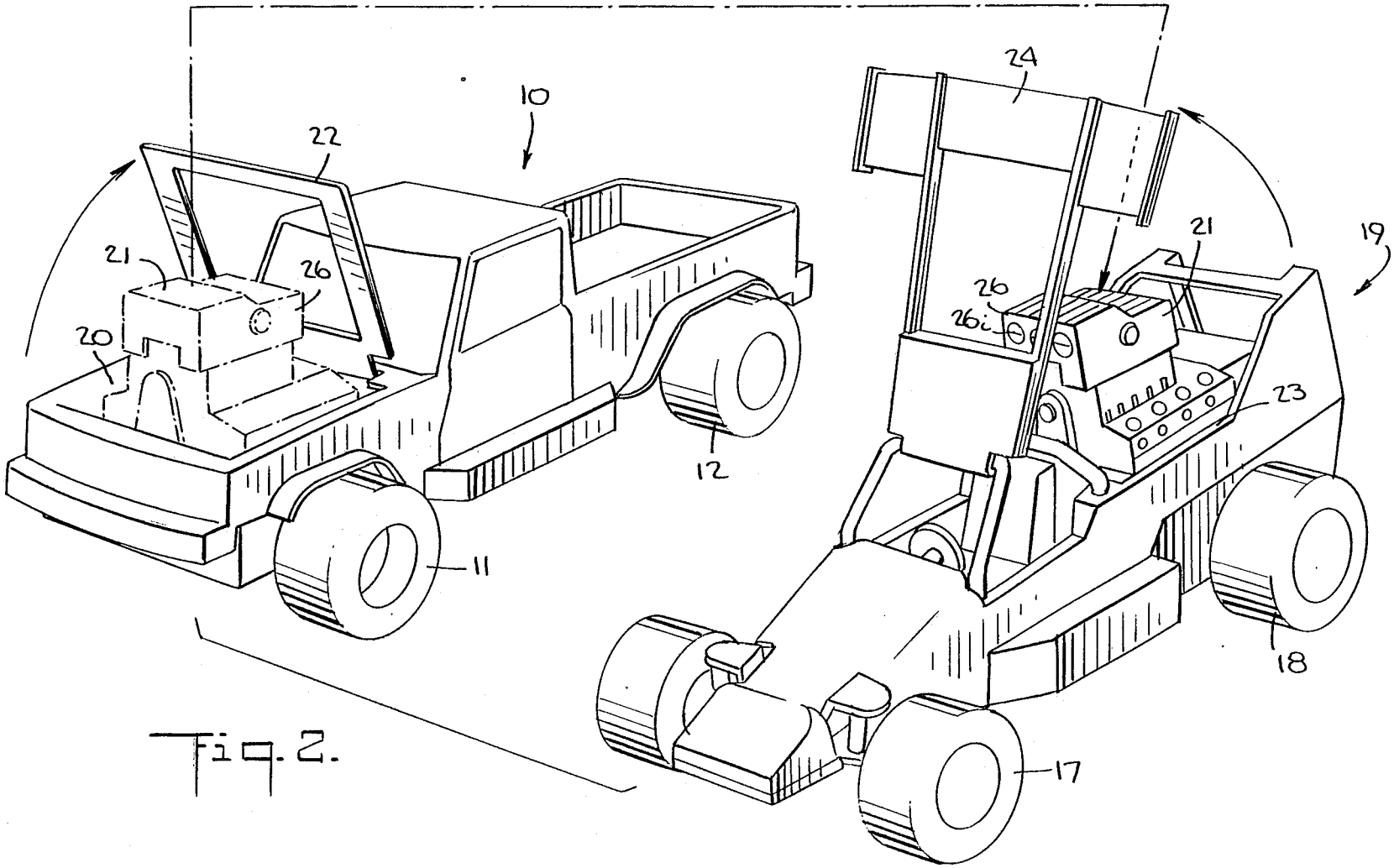
FIG. 2 is a perspective view showing the pick-up truck and the sandscorcher in side-by-side relation, the power module being transferred from the former to the latter.

Referring now to FIGS. 1 and 2, there is shown an assembly in accordance with the invention constituted by a toy pick-up truck 10 having front and rear wheel sets 11 and 12 and a hitching bracket 13 projecting from the rear of the truck. Hitched onto bracket 13 is a flat bed trailer 14 having a pair of parallel tracks 15 and 16 thereon to accommodate the front and rear wheel sets 17 and 18 of a sandscorcher toy vehicle 19.

Pick-up truck 10 is provided at the front portion of its body with an open compartment 20 adapted to receive a plug-in power module 21. Compartment 20 is covered by a hinged hood 22 having a rectangular opening 22A therein to accommodate the upper section of module 21 which projects above the body of the truck. Thus to install the power module, one must first raise the hood to obtain access to the open compartment.

Module 21 has housed therein a DC motor and a battery supply therefor, the motor being operatively coupled to a wheel axle of the vehicle into which the module is plugged. When module 21 is switched on, it acts to propel the vehicle in a selected direction. In FIG. 1, module 21 is plugged into pick-up truck 10, and when switched on to drive this truck in the forward direction, truck 10 then pulls trailer 14 and sandscorcher 19 carried thereon.

Sandscorcher 19 is provided in the rear portion of its body with an open compartment 23 adapted to accommodate the same power module 21. Compartment 23 is covered by a hinged, wing-like cover 24 having a rectangular opening 24A therein through which projects the upper section of module 21 when it is plugged therein, as shown in FIG. 2.

One possible play activity of the assembly is to plug power module 21 into pick-up truck 10 in order to drive this truck over smooth terrain to a play region having rough or sandy terrain, the truck hauling trailer 14 and sandscorcher 19 carried on the trailer to this region. Then, as shown in FIG. 2, when the assembly arrives at this region, the sand-scorcher 19 is taken off the trailer, and power module 20 is withdrawn from pick-up truck 10 and transferred to sandscorcher 19 where it is plugged into the open compartment 23 to power this vehicle so that it can travel over the rough terrain.

The power module, as will be later explained in greater detail, is selectively operable to function in either the forward or reverse drive mode, or in a neutral mode in which the DC motor is cut off.

Power Module

As shown in FIGS. 3 to 6, power module 21 is provided with a molded plastic case 25 having a box-like lower section 25L, above which is an upper section 25U whose surface is metallized and whose configuration is similar to that of the engine block of a multi-cylinder internal combustion engine. The imitation engine has eight cylinders, four of whose heads are represented by a row of circular indentations Ch on one inclined wall of the engine block, the other four heads being represented by like circular indentations on the opposite inclined wall. The front wall of the module is molded to suggest the crankshaft mechanism Cs of the engine.

Figure 6:
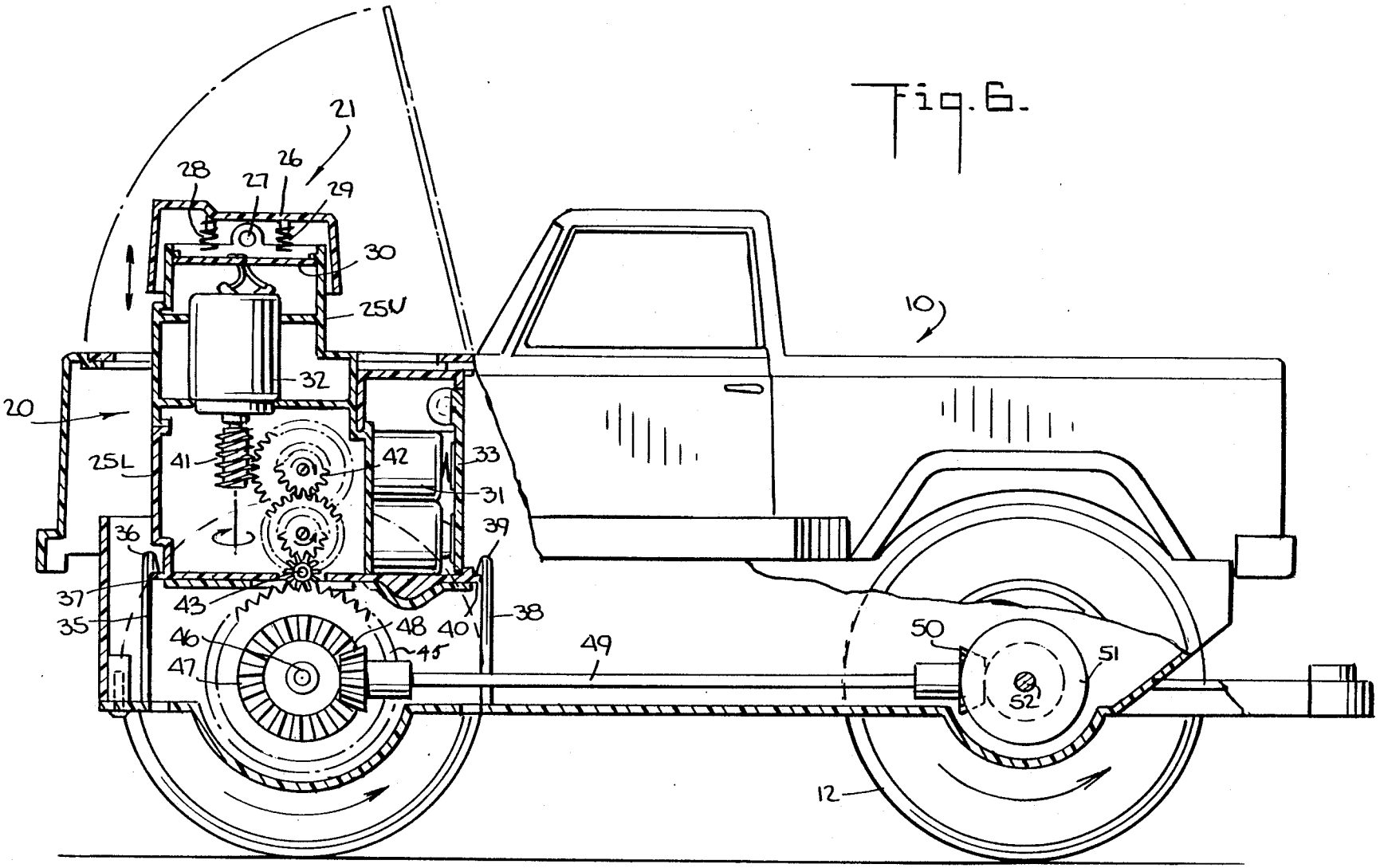
FIG. 6 is an elevational view, partly in section, of the pick-up truck with the power module plugged therein.

Pivotally mounted on a pivot pin 27 on top of upper section 25U of the case is a rocker 26 whose form is such as to simulate an air scoop for an engine having an array of air inlets $26_i$. Rocker 26, which is formed of plastic insulating material, serves as the actuator of a polarity-reversing switch. This switch, as shown in FIG. 6, includes two pairs of like metal springs 28 and 29 anchored on the underside of rocker 26, these springs functioning as the movable contacts of the switch. In the neutral position of rocker 26, the spring contacts are disengaged from the fixed contacts of the switch.

The polarity-reversing switch is constituted by the front and rear pair of movable spring contacts 28 and 29 anchored on rocker 26 and fixed contacts (not shown) formed on a printed circuit plate 30 supported on the top end of case section 25U under the rocker. This switch acts to connect a battery supply composed of four batteries 31 housed in lower section 25L of the case to a miniature DC motor 32 housed in upper section 25U of the case. The printed circuit is such that when engaged by the front pair of spring contacts 28, the battery supply is then connected in one polarity to the motor, and when engaged by the rear pair of spring contacts 28, a crossover connection is effected to reverse the polarity of the applied voltage. As best seen in FIG. 5, lower section 25L is provided with a hinged access lid 33 for the four batteries 31 to be housed therein, a pair of batteries being received on one side of a central gear box 34, the other pair being received on the other side of this box.

When rocker 26 is manually tilted down toward the front, then the front pair 28 of the spring contacts engage fixed contacts on printed circuit plate 30 to apply the battery supply voltage to motor 32 in a polarity causing the motor to turn in a direction producing forward motion of the vehicle powered by the module. And when rocker 26 is tilted down toward the rear, then spring contacts 29 engage fixed contacts on plate 30 to apply the supply voltage to the motor in the reverse polarity, causing reverse motion of the vehicle.

Powered Pick-Up Truck

FIG. 6 shows the power module 21 plugged into the open compartment 20 of the pick-up truck 10. The truck includes as a front pair of upright, flexible fingers 35 anchored on the chassis of the vehicle adjacent the front end thereof and having hooks 36 at their upper ends which when the module is fully inserted, engage a front ledge 37 on the base of the module. Also anchored on the chassis is a rear pair of upright flexible fingers 38 having hooks 39 at their upper ends which engage a rear ledge 40 on the base of the module. The two sets of engaged fingers hold the plugged-in module in its operative position.

The hooks on the fingers have curved heads so that when the module is inserted, the front and rear ledges engage the heads of the flexible fingers and deflect them outwardly to admit and latch the ledges under the hooks; hence the module snaps into place. To remove the module, one simply shifts it slightly sideways to disengage the ledges of the module from the flexible fingers.

Motor 32 has a worm gear 41 mounted on its armature shaft, this gear engaging the input gear of a gear train 42 supported in gear box 34. The gear train operatively couples the motor to a drive pinion 43 whose teeth project through an opening 44 in the base of the power module and are therefore exposed (see FIG. 4).

As shown in FIG. 6, pinion 43 engages a coupling gear 45 mounted on the front axle 46 of the front wheel set at an intermediate position thereon. Integral with coupling gear 45 is a ring gear 47 which meshes with a front bevel gear 48 at the front end of a horizontal shaft 49 whose rear end terminates in a rear bevel gear 50 that meshes with a coupling gear 51 mounted on axle 52 of the rear wheel set.

Hence this arrangement provides four wheel drive; for drive pinion 43 of the power module acts to turn both the front and rear wheel axles of the vehicle.

Powered Sandscorcher

Figures 7, 8:
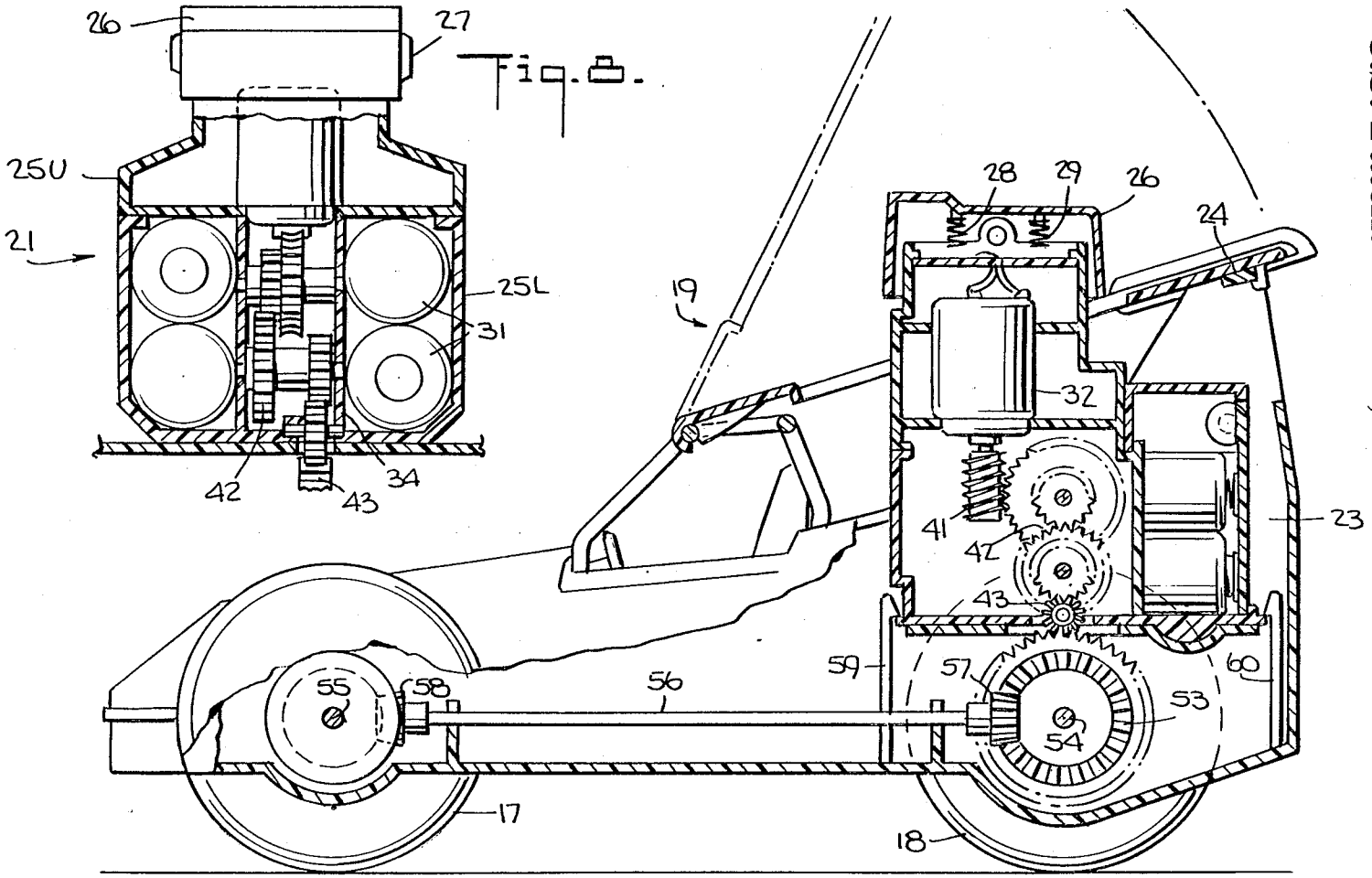
FIG. 7 is an elevational view, partly in section, of the sandscorcher with the powermodule plugged therein.
FIG. 8 is a transverse section taken through the power module showing the gear train which couples the DC motor to the drive pinion.

When the power module is plugged into the motor compartment 23 of sandscorcher 19 as shown in FIGS. 7 and 8, then drive pinion 43 of the module engages a coupling gear 53 mounted on the rear axle 54 of this vehicle. Drive power is transmitted from this rear wheel axle to the front wheel axle 55 by means of a horizontal shaft 56 having gears 57 and 58 at opposite ends thereof. Front and rear pars of flexible fingers 59 and 60 serve to engage the front and rear ledges at the base of the module to hold the module in place in the manner as in the pick-up truck.

The power module lends itself to use in any motorless vehicle provided with an open compartment which is positioned above a coupling gear mounted on a wheel axle. It is not essential that both axles be driven, for a two wheel drive rather than a four wheel drive is acceptable. The obvious advantage of four wheel drive is that the toy vehicle can then negotiate relatively rough terrain.

In practice, one may provide a player with a group of different toy vehicles such as buses, trucks, tractors and a variety of other toy vehicles, and a common plug-in power module to power any of these vehicles. In this way, the child is afforded a broad range of play possibilities to maintain his interest. A vehicle included in the group may incorporate hoists and other motor-driven expedients which can be selectively coupled to the drive pinion of the module so that the player can pick up loads or carry out other play activities. And the vehicle may take the form of a toy boat whose propeller is coupled to the drive pinion of the plug-in module.

While there has been shown and described a preferred embodiment of a plug-in module for motorized toy vehicle in accordance with the invention, it will be appreciated that many changes and modifications may be made therein without, however, departing from the essential spirit thereof.

In FIG. 6, vehicle 10 is shown with four wheel drive. In practice, a rear wheel drive may be provided by freely mounting coupling gear 45 on front wheel shaft 46 so that it acts as an idler gear to transmit the drive through shaft 49 to the rear wheel axle. The gear ratio of the gear train in the power module may then be chosen to provide a higher vehicular speed than with four wheel drive.

The power module can be used in conjunction not only with vehicles but also with various types of power equipment toys which are similar in appearance and operation to those found on construction sites, farms, factories, gas stations and railroads, the power module serving as the primary energy source. Thus the module may be used on a toy crane trailer to operate the crane up and down, it can be used to power a toy coal conveyor or to power a garage platform lift for a toy automobile.

We claim:

1. The combination of a motorless toy vehicle having a body and a wheel axle and a power module adapted to plug into an open compartment in the body of said motorless toy vehicle to drive the vehicle in a desired direction, said compartment being disposed above a coupling gear mounted on said wheel axle, the module comprising:

A a case having a base;

B a DC motor housed in the case and operatively coupled to a drive pinion whose teeth project through an opening in the base to engage said coupling gear when the power module is plugged into said compartment, said case having a height exceeding that of the compartment and having a form resembling the appearance of a multi-cylinder internal combustion engine where an upper section of said case extends above the compartment and is continuously exposed to view;

C a battery supply housed in the case; and

D a polarity-reversing switch including an actuator positioned on top of the case, said switch connecting said supply to said motor whereby in one switch position, the motor is energized to drive the vehicle in the forward direction, and in another position the motor is energized to drive the vehicle in the reverse direction.

2. The combination as set forth in claim 1, wherein said case has a box-like lower section which houses said battery supply, and an upper section which houses the motor and is configured to resemble the engine block of the engine.

3. The combination as set forth in claim 2, wherein said actuator of the switch is in the form of a rockable air scoop pivotally mounted above the upper section of the case and functions as a rocker which when tilted down toward the front actuates the switch to effect forward motion of the vehicle, and when tilted down toward the rear actuates the switch to effect reverse motion of the vehicle.

4. The combination as set forth in claim 1, wherein said case is provided at its base with front and rear ledges, and said vehicle is provided with front and rear flexible fingers which are anchored on the chassis of the vehicle and have hooks at their upper ends that engage and latch said ledges.

5. The conbination as set forth in claim 3, wherein said switch is provided with front and rear pairs of spring contacts anchored on the underside of the actuator, said spring contacts engaging fixed contacts on a printed circuit plate mounted at the upper end of the case to effect polarity reversal when the actuator is tilted toward the front or the rear.

6. The combination as set forth in claim 1 wherein said motor is provided with a worm gear on its armature shaft that is coupled through a gear train to said pinion gear.

7. A module as set forth in claim 6, wherein said gear train is housed within a central gear box in the lower section of the case, and said supply is constituted by two pairs of batteries housed in said lower section, one pair on each side of the gear box.

8. The combination as set forth in claim 1 for a vehicle having front and rear wheel axles in which said coupling gear is on the front wheel axle and is operatively coupled to a coupling gear on the rear wheel axle to effect four wheel drive.

9. The combination as set forth in claim 8, wherein said rear wheel axle is provided with a rear coupling gear that engages a gear at the rear end of a horizontal shaft whose front end terminates in a gear that engages the coupling gear on the front wheel axle.

* * * * *